United States Patent [19]

Lindsey, Jr.

[11] Patent Number: 4,603,743

[45] Date of Patent: Aug. 5, 1986

[54] HYDRAULIC/MECHANICAL SETTING TOOL AND LINER HANGER

[75] Inventor: Hiram E. Lindsey, Jr., Midland, Tex.

[73] Assignee: MWL Tool & Supply Company, Midland, Tex.

[21] Appl. No.: 697,231

[22] Filed: Feb. 1, 1985

[51] Int. Cl.[4] ..... E21B 19/10; E21B 43/00

[52] U.S. Cl. ..... 166/382; 166/124; 166/212; 166/208

[58] Field of Search ..... 166/123, 124, 208, 212, 166/217, 382

[56] References Cited

U.S. PATENT DOCUMENTS

| | | | |
|---|---|---|---|
| 3,934,652 | 1/1976 | Cochran | 166/382 |
| 4,096,913 | 6/1978 | Kenneday et al. | 166/382 |
| 4,393,931 | 7/1983 | Muse et al. | 166/212 |
| 4,399,873 | 8/1983 | Lindsey, Jr. | 166/382 |

*Primary Examiner*—Stephen J. Novosad
*Assistant Examiner*—William P. Neuder

[57] ABSTRACT

A setting tool and a liner hanger for setting a liner hanger in well bores traversing earth formations where the setting tool can be hydraulically operated and released from the liner hanger or alternatively, can be mechanically operated and released from a liner hanger. The tool is provided with bypass areas in the liner hanger and locates the tieback sleeve below the liner hanger. The setting tool incorporates most of the expensive setting mechanism in the setting tool and is not a part of the liner hanger. Thus, the setting mechanism is therefore removable from the wellbore and can be reused on other liner hangers.

32 Claims, 9 Drawing Figures

HYDRAULIC/MECHANICAL SETTING TOOL AND LINER HANGER

FIELD OF THE INVENTION

The present invention relates to setting tools and liner hangers for use in well bores which traverse earth formations and more particularly to a setting tool and liner hanger which can be either hydraulically operated or mechanically operated to set a liner hanger in a well bore.

BACKGROUND OF THE PRESENT INVENTION

In the completion of oil wells it is customary to have a succession of smaller diameter boreholes as a function of depth, each of the boreholes being lined with a tubular pipe member, and each of which are successively cemented in place. The column of cement between the outer surface of the string of pipe and the borehole wall supports the pipe and prevents fluid migration.

As a matter of terminology, a string of pipe extending from the surface is commonly called a casing. The surface borehole is drilled a few thousand feet and the surface casing inserted in the borehole and cemented in a conventional manner. Thereafter, a smaller diameter bit is used to drill another section of open borehole and a string of casing can be inserted into the second borehole which extends to the surface and is cemented in place in a conventional manner. Alternatively, a liner can be suspended in the lower end of the surface casing and cemented in place. A liner is a string of pipe which is hung at the lower end of another string of pipe which is already in the wellbore. After the next casing or liner is in position in the borehole, the drilling is continued to another depth and a liner string of pipe is suspended in the lower end of the next above string of pipe and cemented in place. The drilling operations continues thusly until the desired depth is reached.

To position and cement a liner in a string of casing, the liner is made up with the usual bottom hole equipment which includes a casing shoe, a float collar and plug catchers and is connected up to the desired length. At the top of the liner is a liner hanger, which is an assembly having slip elements which are normally retracted while going into the borehole and which are released downhole when the setting of the liner hanger is desired. The liner hanger is lowered into the borehole by a setting tool which attaches to the liner hanger and a string of pipe attached to the setting tool. At the desired location where the casing shoe is preferably located above the bottom of the open borehole, the liner hanger is set in the next above casing by actuating the setting tool to set the slips on the liner hanger. Upon setting the liner hanger, the weight of the liner is suspended by the liner hanger on the next above casing. The liner is then cemented by pumping cement through the string of pipe, through the liner and into the annulus between the liner and the open borehole. This setting tool and running string are then removed. After the cement is set up, remaining cement in the liner is removed by drilling through the liner and the destructible cementing equipment in the lower end of the liner.

Liner hangers can be set either mechanically of hydraulically. Mechanically set liner hangers are set by manipulation of the setting tool and often present problems in operation of the setting and release of the setting tool from the liner hanger particularly in deep or deviated wells. Hydraulic operated setting tools operate by providing a pressure barrier in the string of pipe below the liner hanger and pressuring up the string of pipe above the liner hanger to produce a relative movement between a slip and expander to set the slips on the liner hanger into gripping engagement with the well casing. Hydraulic hangers also fail to set from time to time and when either a mechanical or hydraulic tool fails to operate it is necessary to remove the entire string of pipe and utilize another tool or liner hanger which involves considerable expense.

The liner hanger itself is designed to have a minimum clearance between the outer surfaces of the liner hanger and the liner or casing through which it passes and provides the largest possible bore through the center of the liner hanger. Since there is always drilling mud in the well bore, for control purposes, insertion of the tool in the well bore can be a problem because of the hydraulic effect of fluid in the casing.

Examples of prior art liner hangers are found in the following U.S. patent:

| U.S. Pat. No. | Issued | Inventor |
|---|---|---|
| 3,993,128 | 11/23/76 | Braddick |
| 3,999,605 | 12/28/76 | Braddick |
| 3,934,652 | 1/27/76 | Cochran |
| 4,287,949 | 9/08/81 | Lindsey |

It is a purpose of the present invention to provide a liner hanger and setting tool which can be set and reset hydraulically as well as set mechanically so that the tool can be repositioned in a borehole without requiring a round trip and to make the setting mechanism retrievable with the setting tool so that it may be reusable.

THE PRESENT INVENTION

In the present invention, the tieback sleeve means is located between the liner hanger and the liner casing. Because the tieback sleeve is below the slip assembly, the slip assembly is not subjected to high pressure. The slip assembly on the liner hanger is provided with tandem, longitudinally spaced slips which can support longer lengths of liner. A hydraulic cylinder in a setting tool is coupled to a string of tubing and a fluid access port communicates the interior of the string of tubing to the hydraulic cylinder in the setting tool. When hydraulic pressure is applied to the hydraulic cylinder, it moves to an expanded position and sets the slip elements of the liner hanger. A spring means is disposed between the tubing string and hydraulic cylinder and is compressed upon expansion of the hydraulic cylinder. If the hydraulic pressure is relieved the spring means will contract the hydraulic cylinder and unset the slip elements.

The liner hanger is provided with bypass ports in the slip assembly above the tieback sleeve means and the mandrel of the setting tool has a packoff assembly to seal off the annulus between the tieback sleeve means and the setting tool mandrel.

If it is desired to set the liner hanger slip elements mechanically, a threaded interconnection between the setting tool mandrel and the tieback sleeve means is partially released which permits the setting tool mandrel to be raised so that the slip elements can be retracted and the hanger can subsequently be mechanically set.

DESCRIPTION OF THE INVENTION

Figure 1:
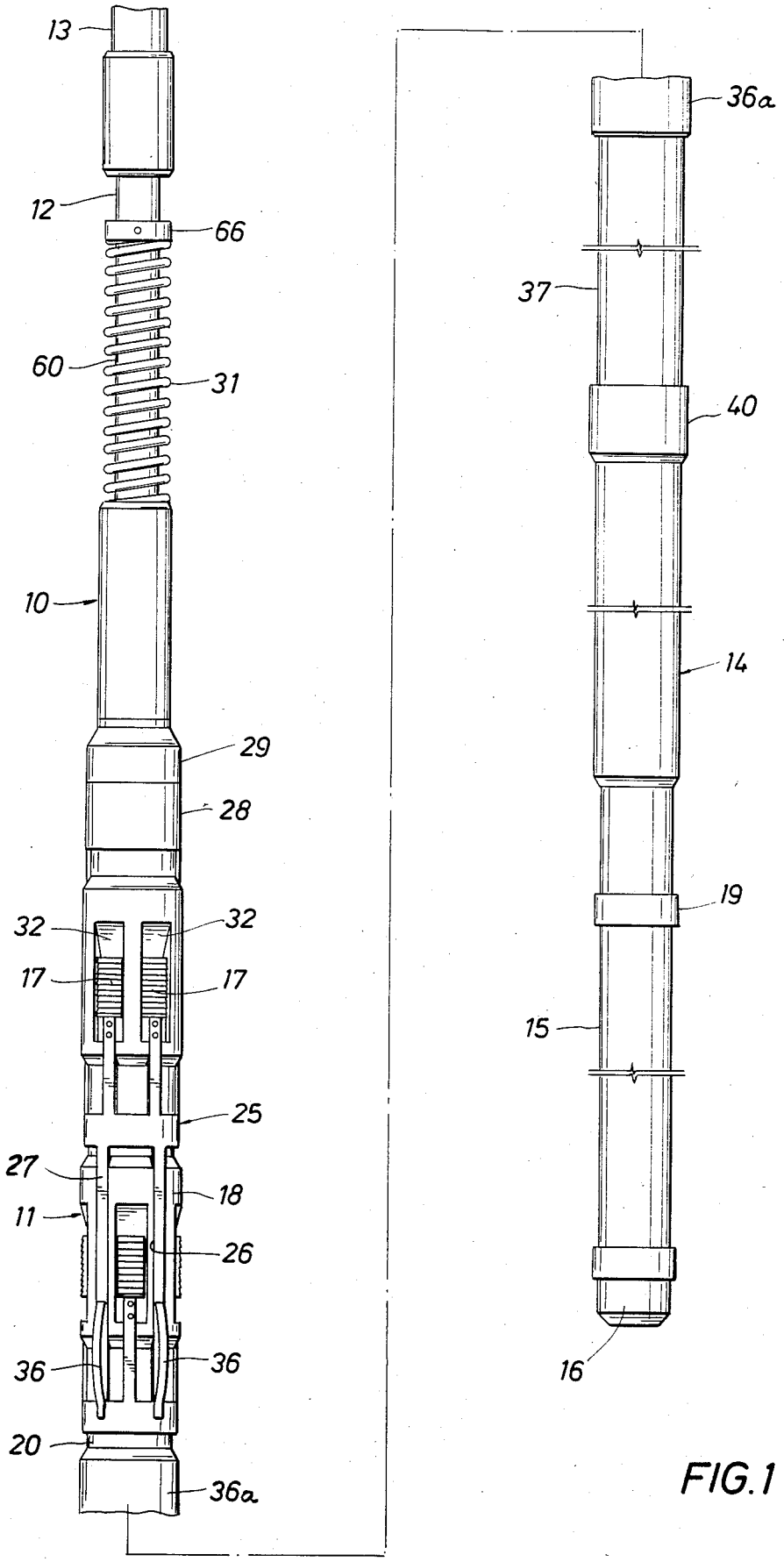
FIG. 1 is a longitudinal view of a tool embodiment of the present invention.

Referring now to FIG. 1, a setting tool assembly 10 and a liner hanger assembly 11 are illustrated in a typical assembly position for going into a well bore or casing. The setting tool assembly 10 is attached at its upper end 12 to a string of tubing 13 and lowered into the casing on the end of the string of tubing. The liner hanger assembly 11 is attached at its lower end 14 to a tubular liner 15 which typically terminates with a casing shoe 16. The setting tool assembly 10 and liner hanger assembly 11 are releasably interconnected to one another so that after the liner hanger slips 17 are set in a well casing or liner, the setting tool assembly 10 may be retrieved on the string of tubing.

In a typical operation, it is desired to suspend the liner 15 in the open borehole with the casing shoe 16 above the bottom of the open well bore by means of the liner hanger assembly 11 which is positioned near the lower end of a casing or liner previously set in the well bore. After setting the liner hanger, the annulus volume between the open well bore and the liner is filled with cement to permanently secure the liner in the well bore.

The liner hanger assembly includes slip elements or means 17 and a slip expander housing or means 18 for engaging the lower end of a casing. The slip elements 17 are normally held in a retracted position relative to the expander housing 18 while going in or through a casing to a desired location near the lower end of the casing. As is well known, above the section of open borehole which receives the liner, the well bore is typically lined or cased with a tubular casing and the liner hanger assembly 11 is adapted to be set in a lower section of the lowermost tubular casing in the well bore. When the liner hanger assembly is set, the slip elements are in an extended position in engagement with the tubular casing and support the depending liner in the open borehole with the casing shoe located above the bottom of the well bore.

The setting tool assembly 10 is utilized to hold the slip elements in a retracted condition and to move the slip elements between the retracted condition and an extended position. The setting tool assembly 10 operates in response to hydraulic pressure in the string of tubing to produce a positive relative movement between the slip elements and a slip expander housing. To develop the necessary pressure in the string of tubing to hydraulically set the slip elements, there is a pressure ball tubular collar sub 19 usually located near the bottom of the liner 15. The collar sub 19 typically carries an internal annular sealing sleeve (not shown) which is shear pinned to the collar sub and the sealing ring has an upper seating surface. When a pressure ball is supplied through the string of tubing, the ball seats in the annular sealing sleeve to close off the bore of the sleeve to permit pressure to be increased in a string of tubing for setting the slip elements by virtue of the operation of the setting tool assembly. After the slip elements 17 are set, a further increase in pressure permits shearing of the pin attaching the sealing sleeve to the collar sub 19 so that the sealing sleeve is released and descends into the casing shoe in a well known manner in preparation for the subsequent cementing operation.

The liner hanger assembly 11 includes a tubular cage member 25 which is telescopically and slidably mounted around a tubular expander housing 18. The cage member 25 has longitudinally extended openings 26 (which will hereinafter be more fully explained) and strap members 27 which attach to the slip elements 17. The upper end 28 of the cage member 25 is releasably attached to a pressure housing 29 on a setting tool. The pressure housing 29 is slidably mounted on a mandrel 60 on the setting tool. When hydraulic pressure is applied through the string of tubing 13, the pressure housing 29 and the releasably attached cage member 25 move upwardly and also compress a spring 31. Upward movement of the pressure housing 29 and the releasably attached cage member 25 produces an upward movement of the slip elements 17 and movement of the slip elements from a retracted to an extended position in engagement with a well casing. The slip expander housing 18 has inclined expander surfaces 32 which cooperate with inclined surfaces on the slip elements 17 to cause an outward movement of the slip elements upon relative movement between the slip elements and the slip expander housing.

The cage member 25 has external wall friction means 36 which frictionally engage the wall of the well bore or casing. The wall friction or wall engaging means 36 are not necessary for the hydraulic setting of the tool but are employed, if for some reason or other, the operator desires to set the liner hanger mechanically. A liner hanger body 20 is connected at its lower end to a tie back sleeve means **36*a* which includes a sleeve 37 connected to a packoff housing 40. The pack-off housing 40 provides an internal releasable connection between a seal device on setting tool assembly 10 and the liner hanger assembly 11. The pressure ball collar sub 19 and casing shoe 20 are connected in the lower end of liner 15**.

Figure 2:
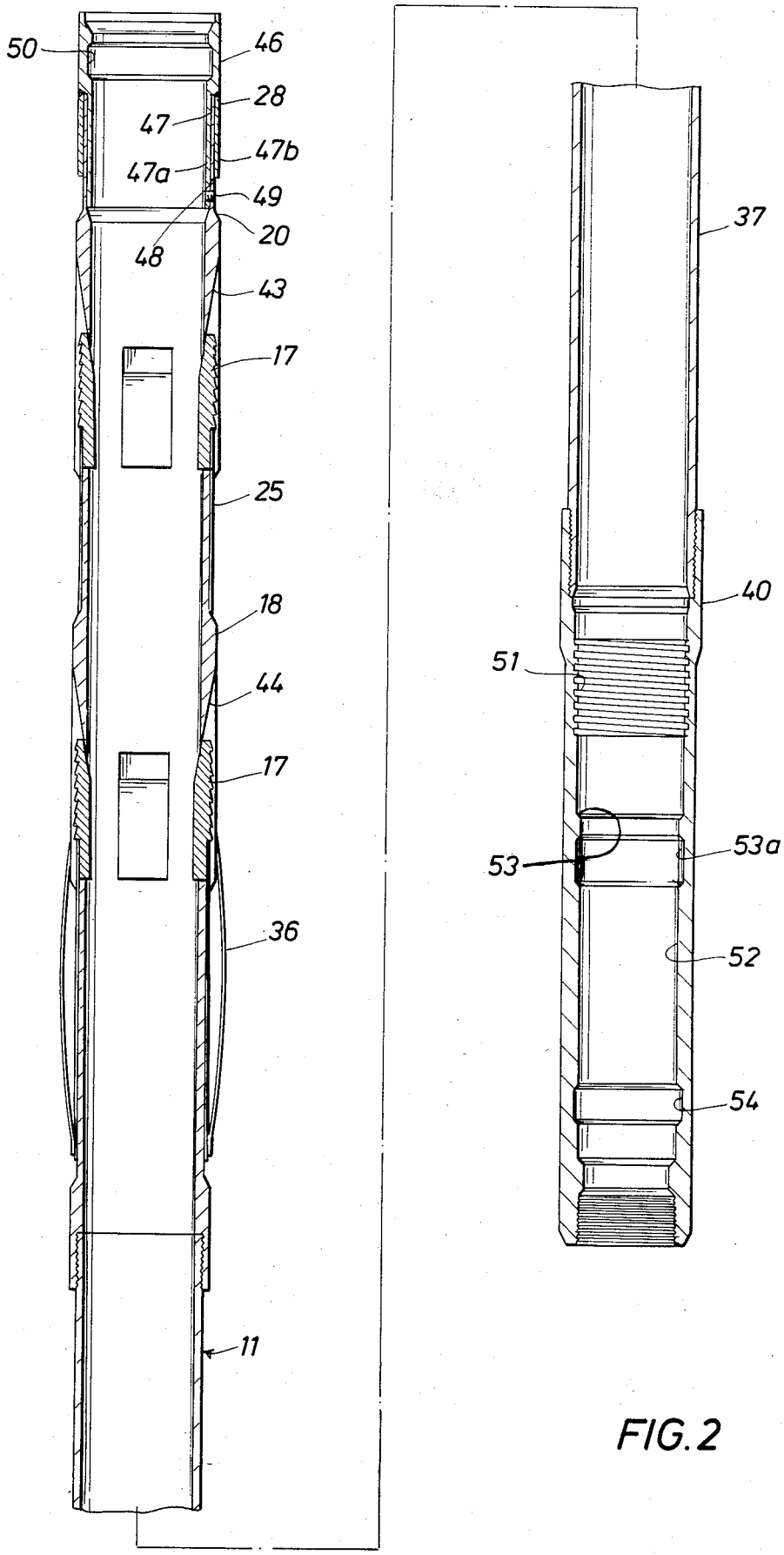
FIG. 2 is a longitudinal view in cross-section of a liner hanger embodiment of the present invention.

Referring now to FIG. 2, a schematic cross section of the liner hanger assembly 11 is illustrated. The liner hanger assembly 11 includes a pack-off housing 40 which is adapted to be connected to the liner. In FIG. 2, the upper and lower inclined surfaces 43, 44 of the expander housing 18 are illustrated in the same vertical plane, although in actuality, the upper set of inclined surfaces on the expander housing are angularly offset around the circumference of the housing by an angle of $22\frac{1}{2}°$ with respect to the lower set of inclined surfaces on the housing 18. Each set of inclined surfaces includes four such surfaces located at 90° positions around the circumference of the housing. The slip elements 17 are interconnected by the tubular cage member 25 which connects to an upper, tubular latch housing 46 at the upper end 28 of the cage member. The tubular latch housing 46 has a lower end which has an inner cylindrical wall 47*a*. An upper cylindrical wall 47*b* of the cage member 25 is attached to the latch housing 46 and the walls 47*a* and 47*b* form an annular recess or cavity 47. The annular recess 47 receives an upper tubular end or cylindrical wall 48 of the liner hanger housing 18. The inner cylindrical wall of the latch housing 46 extends downwardly a distance past the outer cylindrical wall 47*b* so that a shear screws or pins 49 may be used to releasably interconnect the latch housing 46 to the upper end 48 of liner hanger body 20 from the outside of the tool. The screws or pins 49 thus are release means for releasably interconnecting the expander housing and the cage member for retaining the slips on the cage member in a fixed position relative to the expander housing, until released.

At the upper terminal end of the latch housing 46 is an internal annular locking groove means 50 which is sized to releasably receive locking or latching dogs on the setting tool assembly. Below the expander housing 18, the pack-off housing 40 has an internal threaded section 51 which is adapted to receive a threaded release nut on the setting tool assembly. The threaded section 51 and a release nut provide a releasable internal mechanical locking connection or interconnecting release means between the setting tool assembly and the liner hanger assembly. Below the internally threaded section 51 of the housing 40 is a bore 52 with a reduced diameter to provide an upwardly facing landing or seating shoulder 53 for the setting tool assembly. Below the seating shoulder 53 is a lower annular locking groove means 54 to receive locking dogs of a pack-off seal of the setting tool assembly. After setting the liner hanger and removing the setting tool, the housing 40 and tieback sleeve or tieback housing means 37 provide an insert receptacle having internal landing and locking means for receiving an insert tool (not shown). The housing 40 also contains a vertical longitudinal spline groove 53*a* which are used to selectively key the setting tool to the housing.

Figure 3:
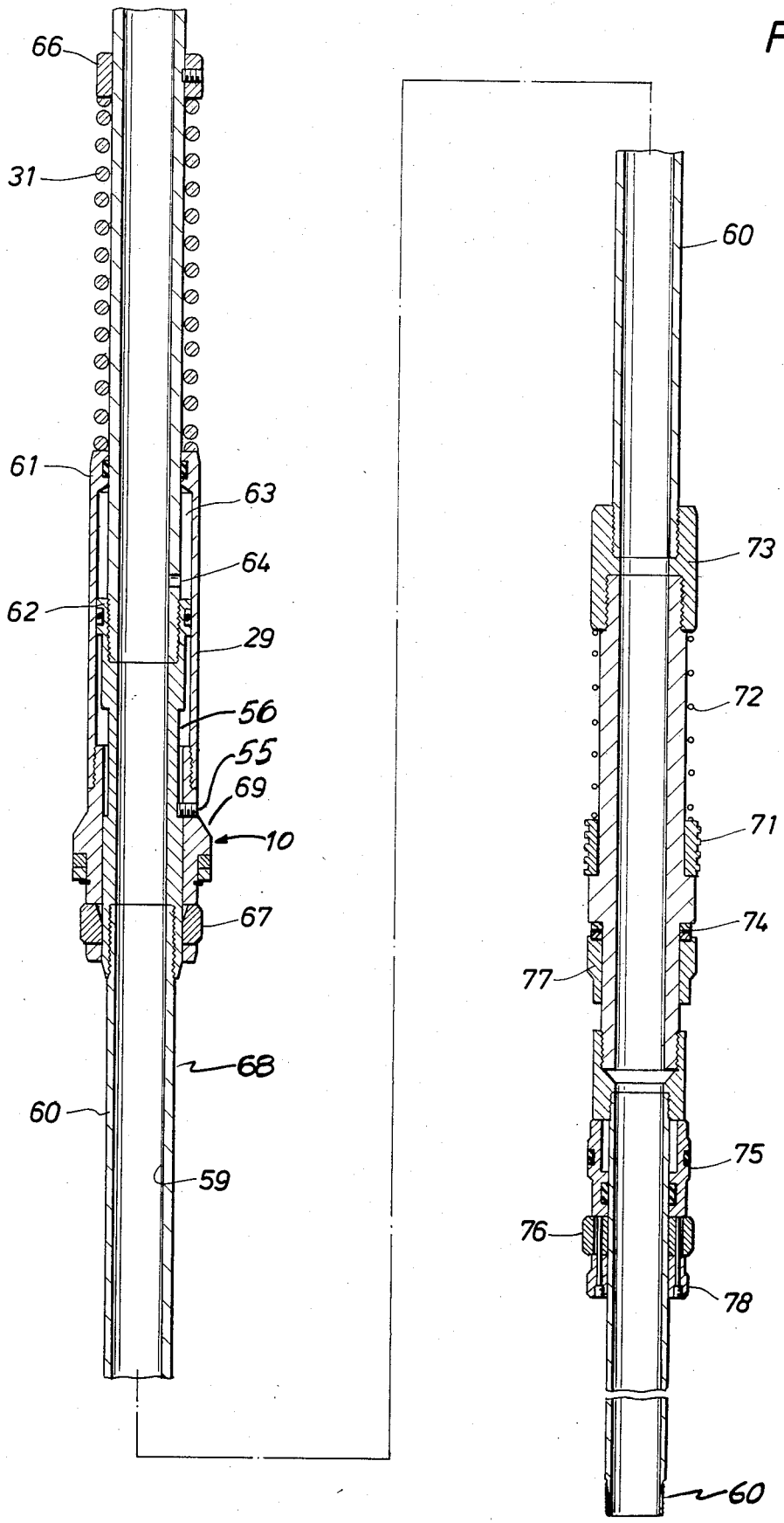
FIG. 3 is a longitudinal view in cross-section of a setting tool for the liner hanger of FIG. 2.

Referring now to FIG. 3, the setting tool assembly 10 is schematically illustrated in cross section and includes a tubular mandrel means 60 which has a generally uniform internal bore 59. At the upper end of the tubular mandrel 60 is an outer telescopically mounted pressure housing 29. The pressure housing 29 has an upper flange 61 slidably and sealingly mounted on the mandrel 60. The mandrel 60 has an external flange 62 slidably and sealing received in the pressure housing 29. The flanges 61 and 62 define a pressure chamber 63 or hydraulic cylinder which has an access port or opening 64 to the inner bore of the tubular mandrel 60 so that hydraulic pressure can move the hydraulic cylinder between a contracted and an expanded condition. A spring 31 is disposed between a stop ring 66 on the tubular mandrel 60 and the flange 61 to normally urge the pressure housing 29 to a lowermost or contracted condition. Threadably connected at the lower end of the pressure housing 29 is a dog housing 69 with dog members or latch members 67 which are received in pockets in the dog housing 69 and are held in an extended position by the outer surface of the tubular mandrel 60 in the normal position of the setting tool assembly as shown in FIG. 3. Between the dog housing 69, which is an integral part of the pressure housing, is a shear pin 55 which extends into an annular recess 56 in the mandrel 60. The annular recess 56 and shear pin 55 permit the hydraulic cylinder to move between contracted and expanded conditions without releasing the latching dogs 67. Then the shear pin 69 is sheared by releasing the mandrel 60 and moving it upwardly, the dogs 67 can be released from their latching engagement. The shear pins 69 are not operable until after the shear pins 69 and traveling nut 71 are released. Below the latching members 67, the tubular mandrel 60 has a reduced wall section 68 which forms a relief or release section so that when the reduced wall section 68 is moved beneath the latching members 67, the latching members 67 can move inwardly to the reduced wall section and out of latching engagement with the locking groove 50 in the liner hanger assembly. As will be appreciated from FIGS. 2 and 3, the latching members 67 cooperate with the latching groove 50 in the latch housing 46. When the latching members 67 are interconnected with the latching groove 50 and hydraulic pressure is applied to the pressure chamber 63 to move the pressure housing 29 upwardly, the shear pins 49 (which interconnect the slip assembly and expander housing) may be sheared and the slip elements 17 can then be moved relative to the expander means 18.

The setting tool assembly at its lower end, has a longitudinally traveling and slidable nut 71 which is slidably and non-rotatably secured to the tubular mandrel 60 by splines (not shown) and normally held in a lowermost position by a spring 72. The spring 72 extends between the traveling nut 71 and an external stop ring 73 on the tubular mandrel 60. Below the traveling nut 71 is a bearing 74 and a landing flange 77 and a tubular pack-off or sealing means 75 which carries latching members or latching dogs 76 in a locking flange or dog housing 78. The landing flange 77 is adapted to cooperate with the seating flange or surface 53 on the liner hanger assembly. When the flange 77 engages the seating surface 53, the latch members 76 are disposed within the annular latching groove 54 in the pack-off housing 40 and normally held in an extended position by the outer surface of the mandrel 60. Below the tubular pack-off member 75, the diameter of the mandrel 60 is reduced at 60*a* to provide a release or relief section so that when the tubular mandrel 60 is moved upwardly relative to the tubular pack-off member 75, the latching members 76 may be retracted from their engagement with the locking groove 54. While not shown, as it is not essential to the present invention, a releasable spline key for spline groove 53*a* can be provided between the nut 71 and the flange 77.

While the sealing or pack-off member 75 is illustrated as a type which releasably locks into the housing 40, it is only necessary that the mandrel 60 be pressure sealed relative to the housing 40, preferably below the traveling nut 71. Thus, the pressure seal or seal assembly can be a simple packing or a pipe or a pipe which inserts through an annular sealing element.

Figure 4:
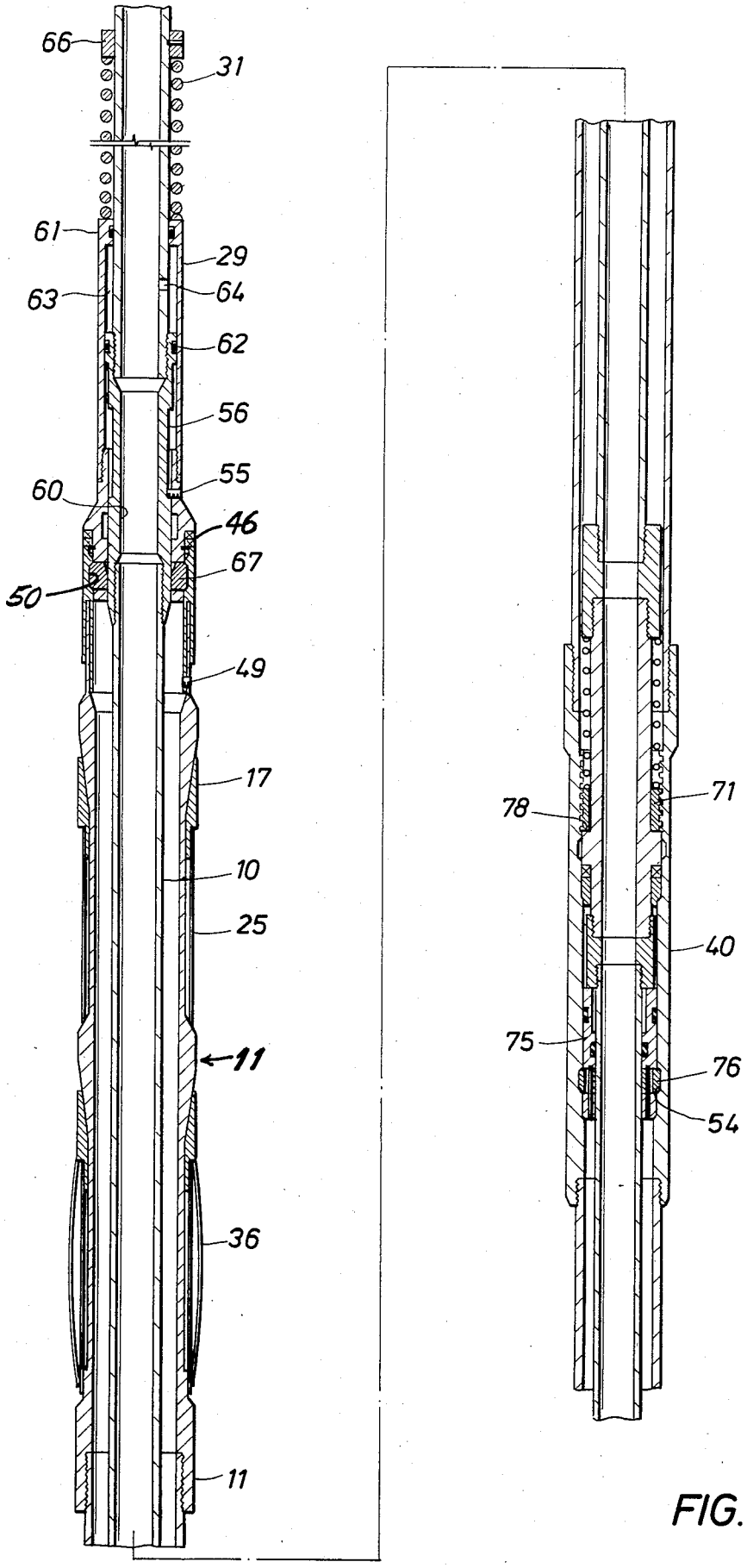
FIG. 4 is a longitudinal view in cross-section of an assembled liner hanger and setting tool.

In FIG. 4, a setting tool assembly 10 is shown interconnected with a liner hanger assembly 11 for transportation into a well bore. As shown in FIG. 4, the slip means 17 on the cage member 25 are initially in a retracted condition and the expander housing 18 in the liner hanger assembly is interconnected to the cage member 25 by the shear pins 49. The entire weight of the liner casing 15 on the liner hanger assembly housing 40 pulls the slidable release nut 71 against an upperwardly facing shoulder 78 on the setting tool assembly. The total liner string weight is thus suspended on tubular mandrel 60. The pack-off assembly 75 on the setting tool is releasably attached to the expander housing 18 of liner hanger assembly by the latching dogs 76 in the pack-off housing 40 while the pressure housing 29 on the setting tool is releasably attached to the cage member 25 by the upper locking dogs 67 in the latch housing 46. When the assembly has been located in the position in the well where the liner hanger assembly is to be set, a sealing ball (not shown) is dropped through the string of tubing and seats in the pressure ball sub 19 to block off the cross section of the string of tubing so that fluid under pressure may be applied through the string of tubing through an access port 64 in the setting tool assembly to the pressure chamber 63 to move the pressure housing 29 upwardly. Because of the locking engagement between groove 50 and latch members 67, latch housing 46 and the interconnected cage 25 also move upwardly relative to the housing 18.

Figure 5:
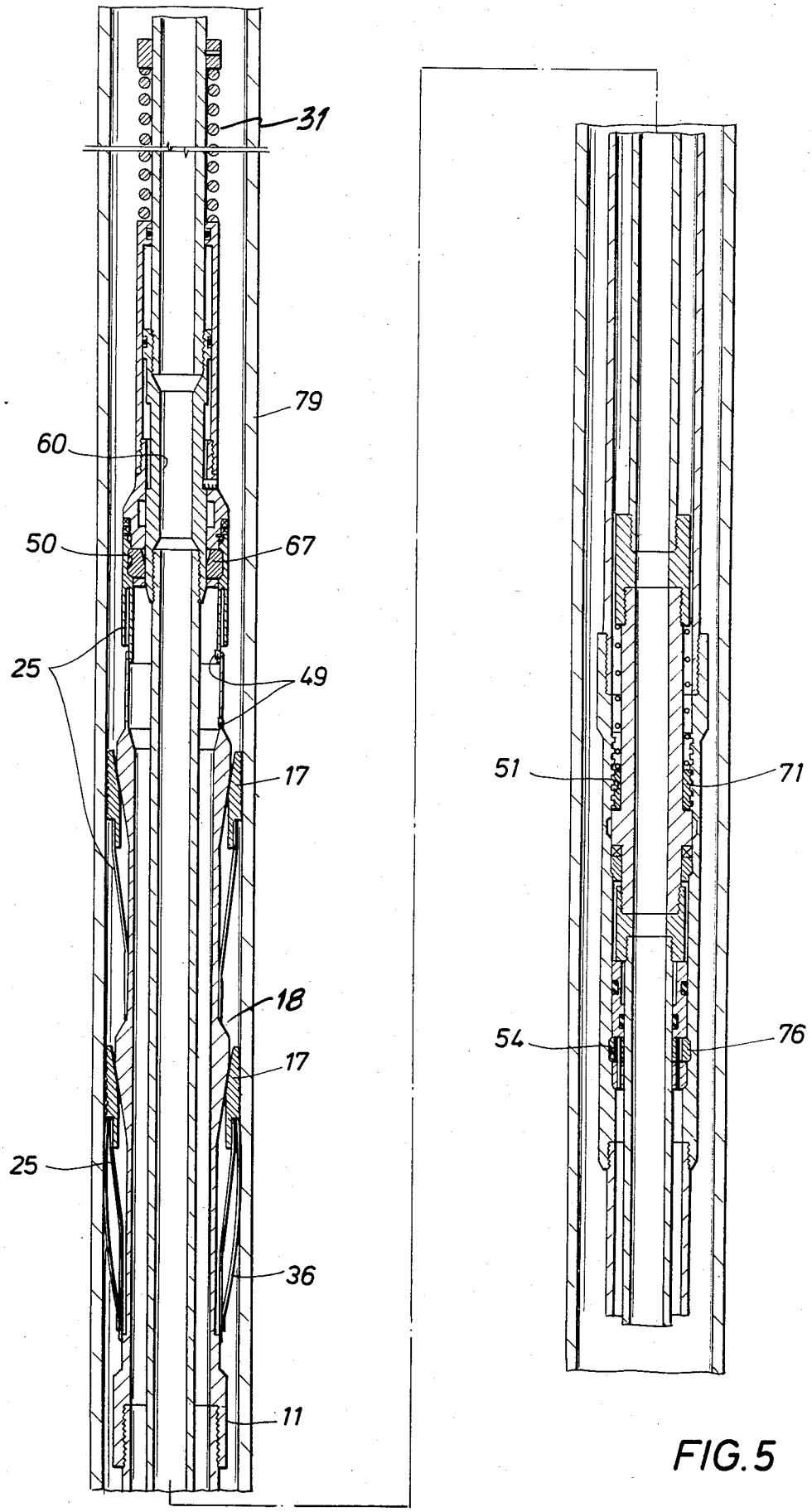
FIG. 5 is a longitudinal view in cross-section of a liner hanger set in a liner.

As shown in FIG. 5, when the cage member 25 is moved upwardly, the shear pin 49 is sheared after the slip means 17 are brought into engagement with the wall of a casing 79. At this time, the latching dogs 67 and 76 are still in a locking arrangement with grooves 50 and 54 respectively and the spring 31 is compressed.

Figure 6:
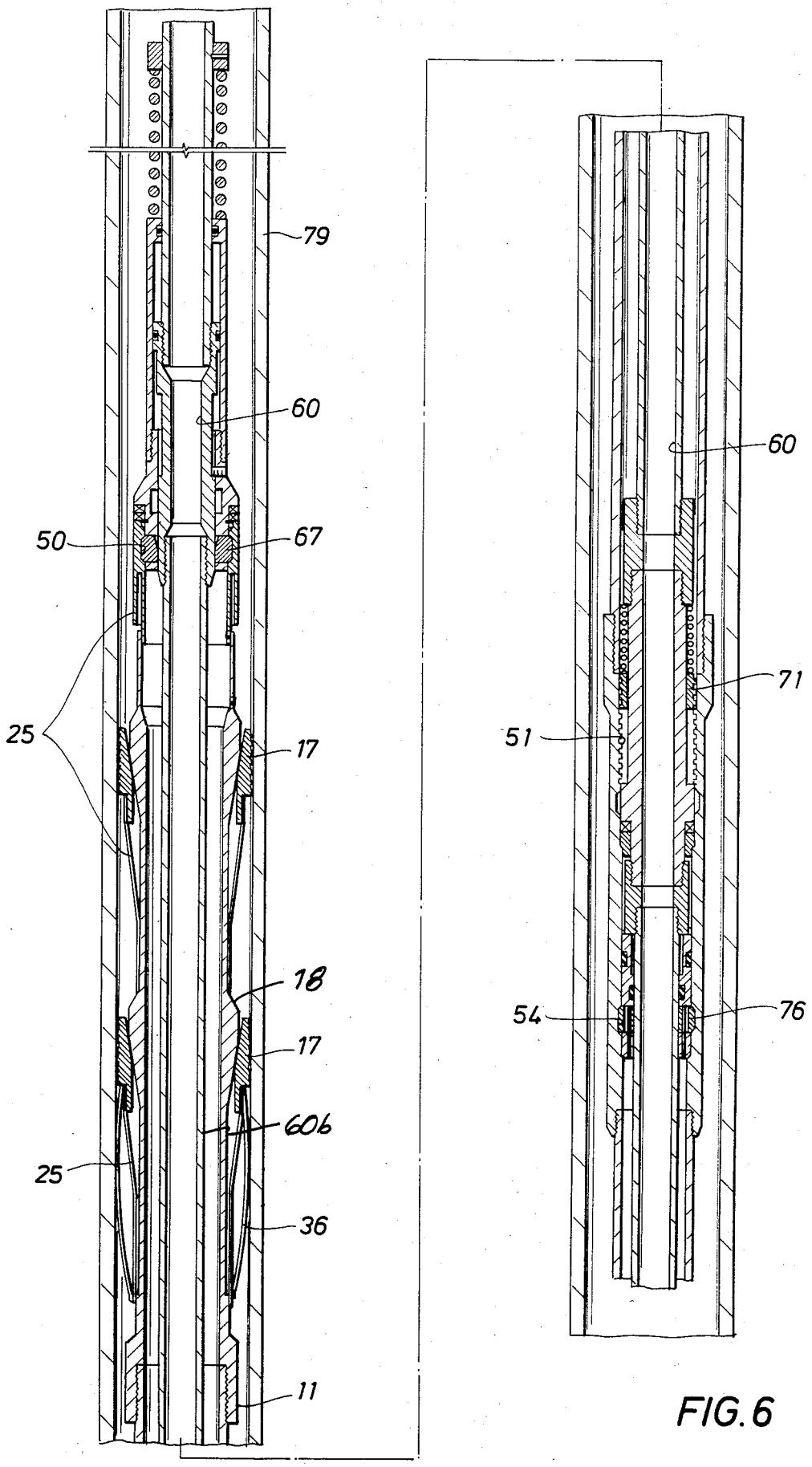
FIG. 6 is a longitudinal view in cross-section of the liner hanger of FIG. 5 with the setting tool in a different position.

Referring now to FIG. 6, after the slip means 17 are brought into engagement with a casing 79, the weight of the liner is now transmitted to the slip means 17 by the expander housing 18 and the weight of the liner is removed from the setting tool and string of tubing. Next, the fluid pressure in the string of tubing is increased to release the pressure ball and sealing sleeve. By release of the sealing ring and moving it to the casing shoe, the pressure in the string of tubing is relieved. Thereafter, the setting tool mandrel member 60 is rotated to the right by rotation of the tubing string so that the traveling nut 71 unscrews from the internal threaded connection 51 in the liner hanger assembly. The position of the tool is as shown in FIG. 6. Once the traveling nut 71 is released from the liner hanger assembly, the setting tool mandrel member 60 may be lifted upwardly with the string of tubing and the reduced wall portion **60*b* on the upper part of the setting tool mandrel member 60 will release the upper dogs 67 from interconnection with the cage member 25 and the reduced wall portion 60*a* (see FIG. 3) on the lower end of the setting tool mandrel member 60 will release the lower dogs 76** so the entire setting tool assembly may be retrieved, leaving the set liner hanger assembly in position in the well bore.

Figure 7:
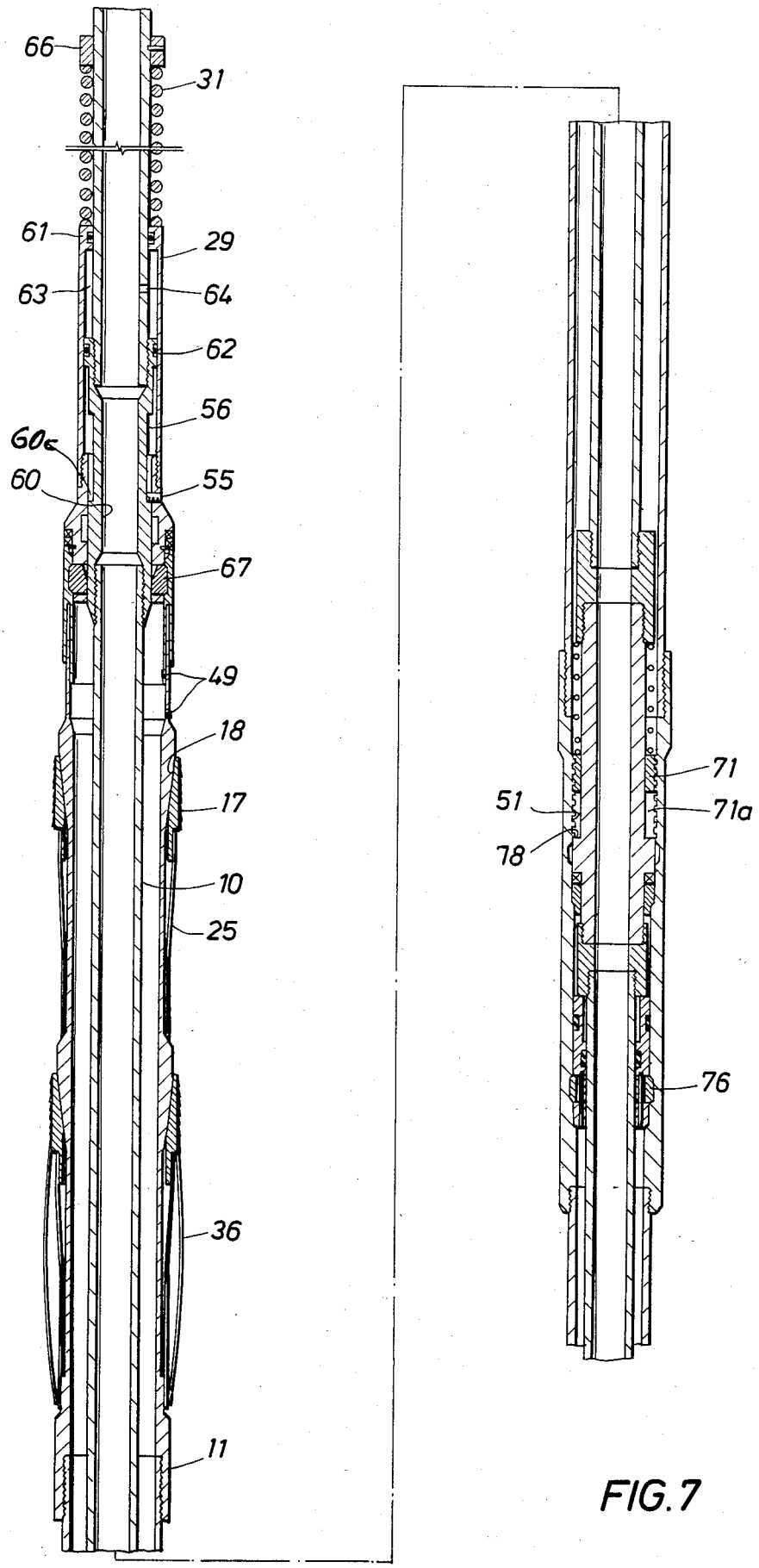
FIG. 7 is a longitudinal view in cross-section of a liner hanger and setting tool in a mechanical setting modes.

If for some reason the tool does not respond to the hydraulic setting and the slips fail to engage the casing, the tool can be set mechanically in the following manner. Before releasing the nut 71 and the locking dogs 67 and 76, the tool is lowered until the casing shoe 16 engages the bottom of the well bore. The tubing string is then rotated to the right to move the traveling nut 71 about half the distance of the internal thread 51 as shown in FIG. 7. A gap **71*a* now exists between traveling nut 71 and shoulder 78 of the setting tool such that when an upward pull is made on the setting string of tubing, an upwardly facing shoulder 60*c* on the tubular mandrel 60 contacts a shear screw 55 which extends into a groove 56 cut into mandrel 60. The shear screw 55 is sized so that it shears at a higher value than shear pins 49 thus any continued upward pull is transmitted through dogs 67 and latch housing 46 causing the pins 49 to shear and the cage member 25 to be pulled upward. When the pins 49 shear, the slips 17 are moved upward and outward along expander means 18 and contact the well casing 79. Continued upward pull on the setting string causes the shear pin or screw 55 to shear next which allows the mandrel 60 to move up relative to dogs 67 until the reduced wall portion allows the dogs 67 to release from latch housing 46 and cage member 25. This movement is not enough to release the dogs 76 from the housing 40. The setting tool shoulder 78 then contacts traveling nut 71 so that the entire liner hanger assembly and expander housing 18 may be pulled upwardly so that the slips are retracted and the liner hanger can be moved upwardly in the well bore. At the desired location, the string of tubing is again lowered and the slip elements are set since the wall friction means 36 contact the well casing constantly so that slacking off a short distance firmly wedges slips 17 into the casing and the liner is completely hung as was shown in FIG. 6. Several more rotations to the right unscrews nut 71 from internal threads 51**. Then by lifting upwardly, the setting tool is now removed as described earlier in respect to the hydraulic operation.

Figure 8:
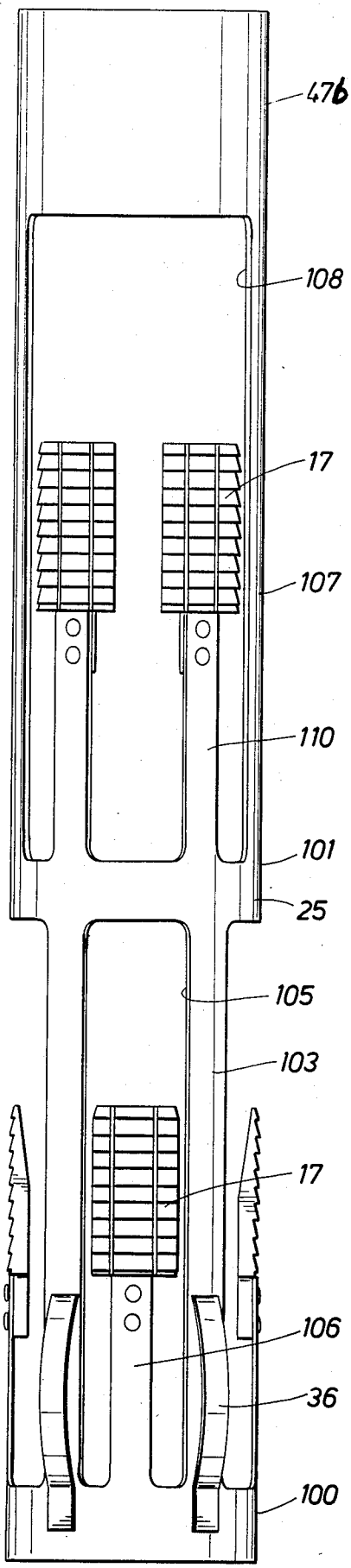
FIG. 8 is a longitudinal view of a cage and slip assembly.
Figure 9:
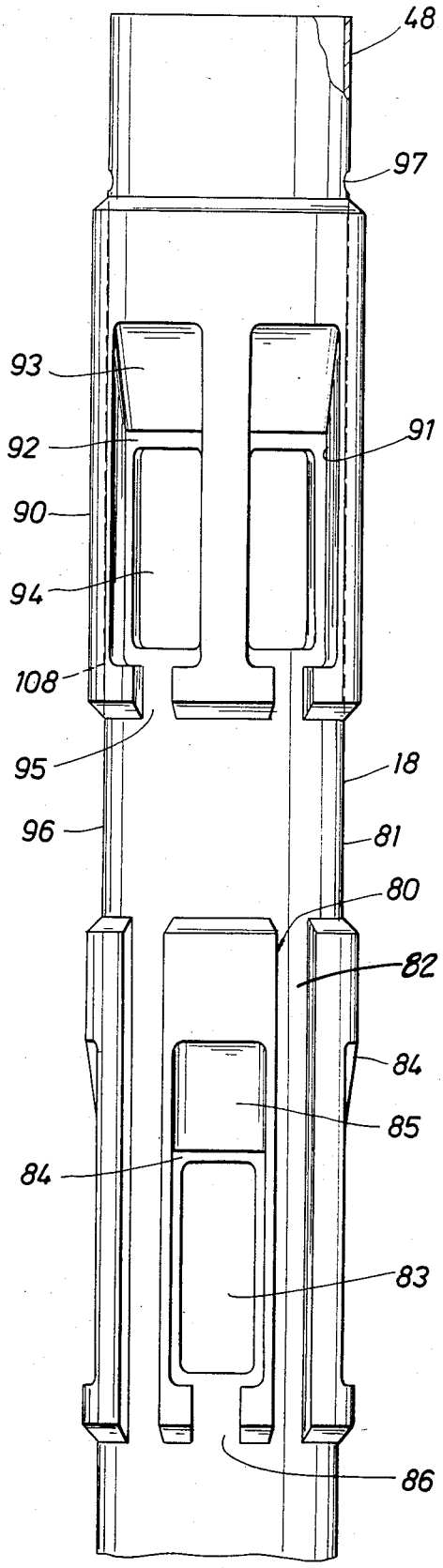
FIG. 9 is a longitudinal view of a mandrel for the cage and slip assembly.

Referring now to FIGS. 8 and 9 of the drawings, in FIG. 8 the portions of outside of the cage member 25 and illustrated and in FIG. 9, portions of the outside of the expander housing 18 are illustrated. The expander housing 18 (FIG. 9) is a tubular member which has four lower segmented sections 80 with a diameter enlarged with respect to the diameter 81 of the housing 18. The segmented sections 80 extend longitudinally of the housing 18 and are circumferentially spaced at 90° about the housing 18 with longitudinal slots 82 between the sections 80. Each of the sections 80 has rectangularly shaped openings 83 extending through the wall of the housing 18 for fluid bypass. Each of the sections 80 has longitudinally extending slip pockets with lower surface portions 84 and outwardly and upwardly inclined portions 85. At the lower end of the pockets are openings or slots 86 to receive strap members.

The expander housing 18 has an upper section 90 of enlarged diameter which corresponds to the diameter of the sections 80. The upper section 90 has circumferentially spaced slip pockets 91 at 90° from one another. Each of the pockets 90 have lower surface portions 92 and outwardly and upwardly inclined portions 93. Rectangularly shaped openings 94 extend through the wall of the housing in the surface portions 92. At the lower ends of the pockets are openings or slots 95 to receive strap members. The upper section 90 is spaced from the lower sections 80 by a section 96 of the housing with a smaller diameter. Above the upper section 90 is the upper tubular end which has diametrically opposed threaded openings 97 to receive the shear screws 49.

Referring to FIG. 8, the cage member 25 may be made in two pieces and assembled on the expander housing 18. The cage member 25 is tubular and has a lower ring portion 100, and intermediate ring portion 101 and upper cylindrical wall 476 which attaches to the latch housing 46. The friction means 36 are attached to the lower ring portion 100 at circumferential locations which correspond to longitudinal strap portions 103. The strap portions 103 are adapted to slide in the slots 82 of the housing 18. Between the strap portions 103 are rectangular elongated openings 105 which slidably receive the sections 80 of the housing 18. Strap portions 106 connect the slip members 17 to the lower ring section 100.

The intermediate ring section 101 has diametrically opposed straps 107 which are slidably received in longitudinal slots 108 in the housing 18. The straps 107 interconnect the wall 47*b* and the intermediate ring portion 101 and define elongated openings 108. In each of the openings 108 are circumferentially spaced straps 110 and slip members 17, the straps 110 being slidably received in openings 95 and the slip members 17 being received in the upper pockets. The openings 108 extend above the shear screw openings 97 so that a shear screw can be inserted in the openings 97.

In the normal position of the slip members 17, they are in a retracted condition in the pockets of the housing 18 and the upper slip members 17 are angularly offset with respect to the lower slip members. Relative movement between the cage member 25 and the housing 18 moves the slip members 17 into an extended or expanded condition in gripping engagement with the wall of a casing.

It will be apparent to those skilled in the art that various changes may be made in the invention without departing from the spirit and scope thereof and therefore the invention is not limited by that which is enclosed in the drawings and specifications but only as indicated in the appended claims.

I claim:

1. A liner hanger for use in hanging a liner in a string of pipe in a borehole comprising:

a tubular expander housing having slip expander surfaces disposed circumferentially around said expander housing;

a tubular cage member telescopically received on said expander housing, slip members attached to said cage member and disposed on said expander surfaces, said slip members being movable on said slip expander surfaces from a contracted condition to an extended position relative to the expander housing upon relative movement between said expander housing and said cage member, said tubular cage member having first internal setting tool locking means in its bore at its upper end; and said expander housing having means adapted for coupling to a liner and having second internal setting tool locking means in its bore, said first and second internal setting tool locking means being adaptable for cooperation with first and second locking means on a setting tool so that said cage member and expander housing can be releasably held in a contracted conditions relative to one another by a setting tool.

2. The apparatus as set forth in claim 1 and further including release means for releasably interconnecting said expander housing and said cage member with said slip members in a contracted condition.

3. The apparatus as set forth in claim 1 and further including wall engaging means on said cage member.

4. A liner hanger for use in hanging a liner in a string of pipe in a borehole comprising:

a tubular expander housing having slip expander surfaces disposed circumferentially around said expander housing;

a tubular cage member having slip members disposed on said expander surfaces, said slip members being movable on said slip expander surfaces from a contracted condition to an extended position relative to the expander housing;

said tubular cage member having first internal setting tool locking means at its upper end;

said expander housing having means adapted for coupling to a liner and having second, internal setting tool locking means, said first and second internal setting tool locking means being cooperable with a setting tool so that said cage member and expander housing can be releasably held in a fixed position relative to one another by a setting tool, and tieback housing means coupled to the lower end of said expander housing, said tieback housing having internal landing and locking means.

5. The apparatus as set forth in claim 4 wherein said landing means comprises an upwardly facing shoulder and said locking means is an annular groove.

6. The apparatus as set forth in claim 4 wherein said slip expander surfaces include a first set of circumferentially disposed expander surfaces about said expander housing at a first location and a second set of circumferentially disposed expander surfaces about said expander housing at second location longitudinally spaced from said first location, said first and second set of expander surfaces being angularly displaced relative to one another;

said cage members having upper and lower sets of slip members and having openings defining strap members to interfit between said expander surfaces.

7. A liner hanger for use in hanging in liner in a string of pipe in a borehole comprising:

a tubular expander housing having slip expander surfaces disposed circumferentially around said expander housing;

a tubular cage member having slip members disposed on said expander surfaces, said slip members being movable on said slip expander surfaces from a contracted condition to an extended position relative to the expander housing;

said tubular cage member having first, internal setting tool locking means at its upper end; and said expander housing having means adapted for coupling to a liner and having second internal setting tool locking means, said first and second internal setting tool locking means being cooperable with a setting tool so that said cage member and expander housing can be releasably held in a fixed position relative to one another by a setting tool, and tieback housing means coupled to the lower end of said expander housing, said tieback housing having internal landing and locking means, said first internal setting tool locking means including a tubular latch housing having a depending first cylindrical wall, said cage member having an upperwardly extending second cylindrical wall, said first and second cylindrical walls defining an annular cavity, said expander housing having an upper third cylindrical wall sized for reception in said annular cavity, said release means having shear pin members interconnecting at least said first cylindrical wall and said third cylindrical wall.

8. A setting tool for use with a liner hanger assembly in a wellbore comprising:

a tubular mandrel adapted for coupling to a string of tubing;

a pressure housing slidably and sealingly mounted on said tubular mandrel and defining a hydraulic cylinder, an access opening in said mandrel to said hydraulic cylinder so that hydraulic pressure can move said hydraulic cylinder between a contracted and an expanded condition;

spring means on said mandrel normally biasing said pressure housing to a position where the hydraulic cylinder is in a contracted condition;

latching means on said pressure housing including latching dogs movable between an extended latching condition and a retracted release condition;

said mandrel having different diameter portions for respectively cooperating with said latching dogs to establish the extended and retracted conditions of the latching dogs;

said mandrel having an annular recess and shear means on said pressure housing extending into said annular recess so that said hydraulic cylinder can move between contracted and extended positions without moving said latching dogs from an extended condition, said shear means being shearable to permit release of said pressure housing relative to said mandrel and movement of said mandrel to establish a retracted condition for said latching dogs; and interconnecting release means on said mandrel adapted for interconnecting with a liner hanger.

9. The apparatus as set forth in claim 8 where said interconnecting release means includes a threaded nut member.

10. The apparatus as set forth in claim 9 and further including a seal means on said mandrel for sealing with respect to a liner hanger.

11. The apparatus as set forth in claim 10 wherein said seal means includes a dog housing and locking dogs movable between an extended latching condition and a retracted release condition.

12. A setting tool and liner hanger assembly for use in a well bore comprising:

liner hanger means including a tubular expander housing having an upper end with means for releasably connecting to a tubular cage means;

slip expander surfaces disposed circumferentially about said expander housing;

tubular cage means disposed on said expander housing and carrying slip elements in a cooperating relationship to said expander surfaces, said cage member being movable relative to said expander housing for moving said slip elements from a contracted to an extended condition;

first release means for releasably connecting said cage member and said expander housing with said slips in a contracted condition;

setting tool means including a supporting body member with an upper end adapted for connection with a string of pipe, first releasable interconnecting means on said setting tool means for interconnecting said supporting body member to said tubular cage means;

hydraulic means in said setting tool means responsive to hydraulic pressure for operating said first release means;

second releasable interconnecting means for connecting said setting tool supporting body member to said expander housing and releasable for permitting operation of said first releasable interconnecting means.

13. The apparatus as set forth in claim 12 wherein said setting tool means includes second release means for releasably connecting said first releasable interconnecting means to said supporting body member, said second release means being constructed and arranged to operate so that said first release means and said first releasable interconnecting means can be operated prior to release of said second releasable means.

14. The apparatus as set forth in claim 12 wherein said first releasable interconnecting means includes a housing with an internal locking groove for receiving latching dogs.

15. The apparatus as set forth in claim 12 wherein said cage member has wall engaging friction means.

16. The apparatus as set forth in claim 12 wherein said expander housing has upper and lower expander surfaces and said cage member has upper and lower slip members adapted for cooperation with said expander surfaces, said expander housing having bypass openings located under said slip members.

17. The apparatus as set forth in claim 12 wherein said first release means are shear pins, said first releasable interconnecting means are latching dogs and said second releasable interconnecting means is a threaded nut member which is slidably and non-rotatably received on said supporting body member.

18. The apparatus as set forth in claim 14 wherein said supporting body member has relieved portions adapted to cooperate with said latching dogs for releasing said latching dogs.

19. The apparatus as set forth in claim 12 wherein said supporting body member has seal means adapted for sealing said supporting body member with respect to said expander housing.

20. The apparatus of claim 19 wherein said seal means includes means for releasably connecting said seal means to said expander housing.

21. The apparatus as set forth in claim 20 wherein said expander housing has a locking and landing means for a seal assembly.

22. A setting tool and liner hanger assembly for use in setting a liner and liner hanger in a well bore comprising:

liner hanger means including (a) a tubular housing mandrel adapted for connection to a liner, said tubular housing mandrel having expander means disposed around the circumference of said mandrel;

(b) slip means disposed on said expander means and movable between a contracted condition to an expanded condition in engagement with the wall of a casing;

(c) tubular cage means on said housing mandrel, said cage means being attached to said slip means and including an upper tubular latch housing located above said expander means;

(d) first release means connecting said tubular cage means and said housing mandrel;

(e) said upper tubular latch housing on said cage member having first internal setting tool latching means;

(f) said housing mandrel having second internal setting tool releasable interconnecting means; setting tool means including:

(g) a tubular mandrel adapted for connection to a string of pipe extending from the earth's surface;

(h) first latching means on said tubular mandrel setting tool for releasably coupling said setting tool means to said upper tubular latch housing;

(i) second releasable means on said tubular member for releasably coupling said setting tool means to said second internal setting tool releasable interconnecting means;

(j) hydraulic setting means on said tubular mandrel defining a hydraulic cylinder with access to the bore of said tubular mandrel, said hydraulic cylinder being movable in response to hydraulic pressure for releasing said first release means and for producing relative longitudinal movement between said housing mandrel and said cage means for operating said first release means.

23. The apparatus as set forth in claim 22 wherein said first release means is a shear pin and said second releasable means includes a threaded connection.

24. The apparatus as set forth in claim 23 and further including second release means interconnecting said first latching means and said hydraulic setting means and operable subsequent to operation of said first release means for releasing said first latching means independently of said second releasable means.

25. The apparatus as set forth in claim 24 and further including sealing means on said setting tool means and second latching means for releasably latching said sealing means to said housing mandrel.

26. The apparatus as set forth in claim 25 wherein said first and second latching means include dog members for interconnecting with latching grooves in said housing mandrel and relieved portions on said setting tool mandrel for releasing said dog members from said latching grooves.

27. The apparatus as set forth in claim 24 wherein said cage member has wall engaging friction means.

28. A method of setting a liner hanger and attached liner in a wellbore where the liner hanger has expander and slip means releasably held in a contracted condition and movable upon release to an extended condition and said slip means is attached to wall engaging friction means and where a setting tool on a string of tubing is releasably attached to said slips and expander in the liner hanger comprising the steps of:

lowering a liner and liner hanger releasably attached to a setting tool at the end of a string of tubing into a wellbore until the liner engages the bottom of the wellbore;

releasing the slips relative to the expander housing while maintaining the releasable interconnection of the slips and expander with the setting tool;

raising the liner hanger to the location where the liner hanger will be set while maintaining the slips in a retracted condition;

setting the slips by producing relative movement between the slips and expander; and disconnecting the setting tool from the slips and expander and retrieving the setting tool.

29. The method as set forth in claim 28 wherein the step of releasing the slips relative to the expander includes rotating the string of tubing to move a traveling nut in the setting tool relative to the expander a sufficient distance to permit a shear pin connection between the slips and expander to be sheared, moving the string of tubing relative to the expander to shear the shear pin and release the slips relative to the expander.

30. The method as set forth in claim 29 wherein the step of disconnecting the setting tool from the slips and expander includes:

rotating the string of tubing to move the traveling nut out of engagement with the expander and moving the string of tubing relative to the set slips to release a releasable connection between the setting tool and the slips.

31. A tubular liner hanger for use in hanging a liner in a string of pipe wherein a setting tool is utilized having first and second spaced apart locking means for releasably locking the setting tool to spaced apart locking means on a liner hanger where said liner hanger comprises:

a tubular housing member having slip expander surfaces circumferentially disposed about the housing member, slip means including slip members disposed on said expander surfaces, said slip members being movable on said expander surfaces between a contracted position to an extended position relative to said housing member, said housing member having first internally locking means adapted for releasably locking said housing member to a first, external facing, locking means on a setting tool and where the first locking means on the setting tool are disposed within the bore of the housing member, said slip means having second, internally facing, locking means adapted for releasably locking said slip means to second, externally facing, locking means on a setting tool so that said housing member and said slip means can be releasably locked in a contracted position by first and second spaced apart locking means on a setting tool disposed within the bore of the liner hanger.

32. The liner hanger as set forth in claim 31 wherein said first locking means includes an internal threaded section in said housing member.

* * * * *